US005228213A

United States Patent [19]

Caruso

[11] Patent Number: 5,228,213

[45] Date of Patent: Jul. 20, 1993

[54] STEAMER ATTACHMENT FOR A HAIR CURLER STEAMER

[76] Inventor: Richard Caruso, 619 Croyden Rd., Cheltenham, Pa. 19102

[21] Appl. No.: 863,449

[22] Filed: Apr. 3, 1992

[51] Int. Cl.[5] ..... F26B 19/00

[52] U.S. Cl. ..... 34/60; 392/386; 392/394; 4/537; 34/98; 34/90; 34/91

[58] Field of Search ..... 34/202, 96, 97, 98, 34/90, 91, 12, 60, 61, 104; 392/380, 386, 394, 404, 397; 4/536, 537

[56] References Cited

U.S. PATENT DOCUMENTS

| | | | |
|---|---|---|---|
| 2,881,755 | 4/1959 | Diehl | 392/404 |
| 3,120,851 | 2/1964 | Pollak et al. | 132/9 |
| 3,493,722 | 2/1970 | Popeil | 219/222 |
| 3,495,343 | 2/1970 | Duncanson | 34/98 |
| 3,495,583 | 2/1970 | Katzman et al. | 126/381 |
| 3,645,007 | 2/1972 | Scott | 392/394 |
| 4,314,138 | 2/1982 | Itoh | 219/276 |
| 4,361,966 | 12/1982 | Downey | 34/99 |
| 4,391,047 | 7/1983 | Janssens et al. | 34/97 |
| 4,621,641 | 11/1986 | Frank et al. | 128/368 |
| 4,759,135 | 7/1988 | Scivoletto | 34/97 |
| 4,816,644 | 3/1989 | Frank | 219/271 |
| 5,010,905 | 4/1991 | Snyder et al. | 4/537 |

*Primary Examiner*—Henry A. Bennet
*Assistant Examiner*—Denise L. Gromada
*Attorney, Agent, or Firm*—Woodcock Washburn Kurtz Mackiewicz & Norris

[57] ABSTRACT

An attachment is provided for converting a table top steamer into an apparatus for steam treatment of the body. The attachment comprises an approximately cylindrical conduit having open ends and a plurality of holes located between the first and second ends. The conduit divides the steam jet discharged from the steamer into three streams and diffuses and cools the steam in each of these streams, thereby allowing the face and both hands of the user may be simultaneously steam treated. The attachment is secured to a cover on the steamer by a compression fit. Baffles formed on the open ends of the conduit serve to direct condensate to the vessel.

32 Claims, 4 Drawing Sheets

STEAMER ATTACHMENT FOR A HAIR CURLER STEAMER

FIELD OF THE INVENTION

The current invention is directed to an apparatus for steaming the face and hands. More specifically, the current invention is directed to an attachment for converting a hair curler steamer into a facial/hand steamer.

BACKGROUND OF THE INVENTION

In the past, hair curling systems have been developed that apply steam to hair curlers as an aid to curling. One such system is disclosed in U.S. Pat. No. 3,493,722 (Popeil) and involves soaking an entire set of curlers in a steam chest. A more advanced system is disclosed in U.S. Pat. No. 4,453,554 (Caruso) and involves injecting a jet of steam into a porous hollow curler. Such steam hair curling systems utilize a steam generating unit, typically referred to as a "steamer." Although such steamers are designed primarily for the generation of steam for hair curlers, attempts have been made to adapt them for use as a facial steamer, as disclosed in the aforementioned Popeil patent.

According to Popeil, a shield is placed within the steam chest to guide the steam vertically upward for steaming the face. Unfortunately, this approach suffers from several drawbacks. First, whereas the user often desires to steam both the hands and the face, Popeil only allows steaming of only one body part at a time. Second, the shield is not suitable for converting a more advanced curler system steamer; such as that disclosed in the aforementioned patent to Caruso, to body steaming. This is so because the Popeil shield merely directs the steam flow upward, it neither diffuses nor cools the steam. This is a serious drawback since advanced steamers generate steam in a relatively high velocity jet that cannot be safely discharged directly into the user's face.

Accordingly, it would be desirable to provide an attachment for a hair curler steamer that was capable of simultaneously steaming both the face and the hands as well as diffusing and cooling the steam, making it suitable for use with advanced, jet type steamers.

SUMMARY OF INVENTION

It is an object of the current invention to provide an attachment for a hair curler steamer that is capable of simultaneously steaming both the face and hands as well as diffusing and cooling the steam generated by the steamer. This object, as well as other objects, is accomplished in a steamer comprising (i) a vessel forming a cavity for containing water, (ii) means for transforming at least a portion of the water contained in the cavity to a flow of steam, and (iii) steam flow directing means. The steam flow directing means has (i) first steam flow discharging means for directing a first portion of the steam flow from the steamer in a substantially vertically upward direction, (ii) second steam flow discharging means for directing a second portion of the steam flow from the steamer in a first substantially horizontal direction and (iii) third steam flow discharging means for directing a third portion of the steam flow, from the steamer in a second substantially horizontal direction.

In one embodiment of the current invention, the steam flow directing means comprises a conduit having first and second open ends and a plurality of holes disposed between the first and second ends.

DESCRIPTION OF THE PREFERRED EMBODIMENT

Figure 1:
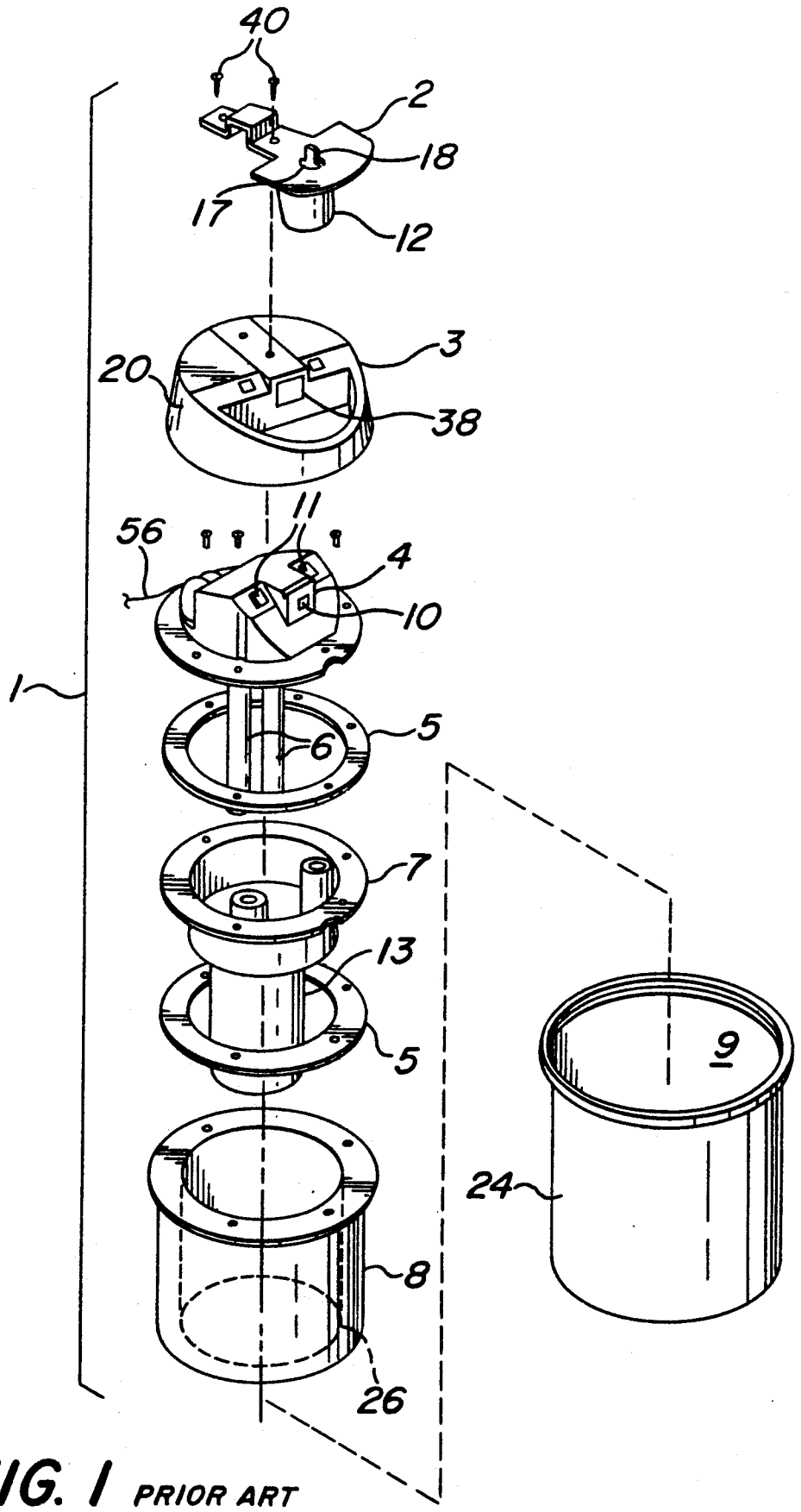
FIG. 1 PRIOR ART
FIG. 1 is an exploded view of a hair curler steamer according to the prior art.

Referring to the drawings in detail, wherein like numerals indicate like elements, there is shown in FIG. 1 a table top steamer 1 according to the prior art, such as heretofore used in conjunction with porous hollow hair curlers disclosed in the aforementioned U.S. Pat. No. 4,453,554 (Caruso), hereby incorporated by reference in its entirety. The steamer I comprises an outer vessel 24 that forms a cavity 9 for containing the water to be transformed into steam. An outer housing 8, having an inner cylinder 26 concentrically disposed therein, is mounted into the vessel 24. An inner housing 7, having a shroud 13 extending downward therefrom, is disposed within the outer housing 8 and sealed thereto by a gasket 5.

As shown in FIG. 1, an inner cap 4, having electrodes 6 mounted therein for heating the water and thereby transforming it into steam, is disposed within the inner housing 7 and sealed thereto with a second gasket 5. Power cables 56 are connected to the electrodes 6. A steam discharge port 10, in flow communication with the cavity 9, is formed in the inner cap 4. In addition, steam vents 11, adapted to vent excess steam to atmosphere when steaming hair curlers, are formed on either side of the steam port 10. A cover 3 having a cylindrical portion 20 is mounted atop the inner cap 4. A steam port 38 is formed in the cover 3 that is concentric with, and therefore in flow communication with, the inner cap steam port 10. Lastly, a plastic handle/curler support 2 is attached to the cover 3 via screws 40.

Figure 3:
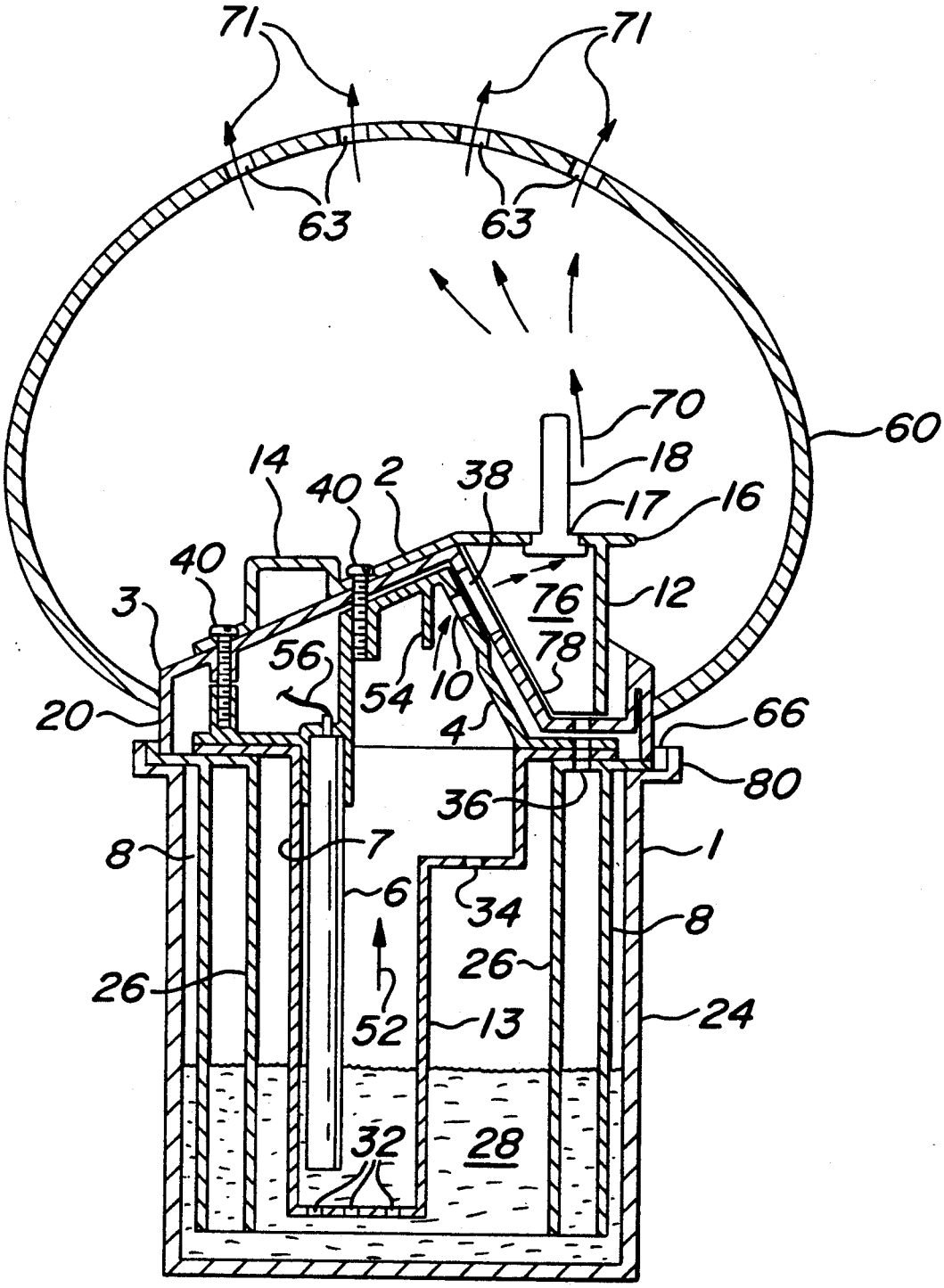
FIG. 3 is a cross-section taken through line III—III shown in FIG. 2.

As shown in FIG. 3, the handle/curler support 2 has a finger grip portion 14, disposed between the attaching screws 40, to facilitate lifting of the steamer A planar portion 16 extends forwardly from the finger grip portion 14. When operating in the hair curler steaming mode, a hair curler (not shown) is placed over a post 18 extending upward from the support 2 and allowed to rest on the planar portion 16. Steam from the inner cap steam port 10 is introduced into the curler via a steam port 17 formed in the planar portion 16. In addition to supporting the curler, the planar portion 16 also serves as a baffle to deflect excess steam discharging from the vents 11 away from the user. A cowl 12 extends downwardly from the planar portion 16 and partially encircles the steam ports 10 and 38. As a result, the cowl 12, in cooperation with the face of the cover 3, forms a sealed conduit for directing the steam generated by the electrodes 6 so that the steam is discharged as a jet of steam 70 through the port 17 into the curler steam passage.

Figure 4:
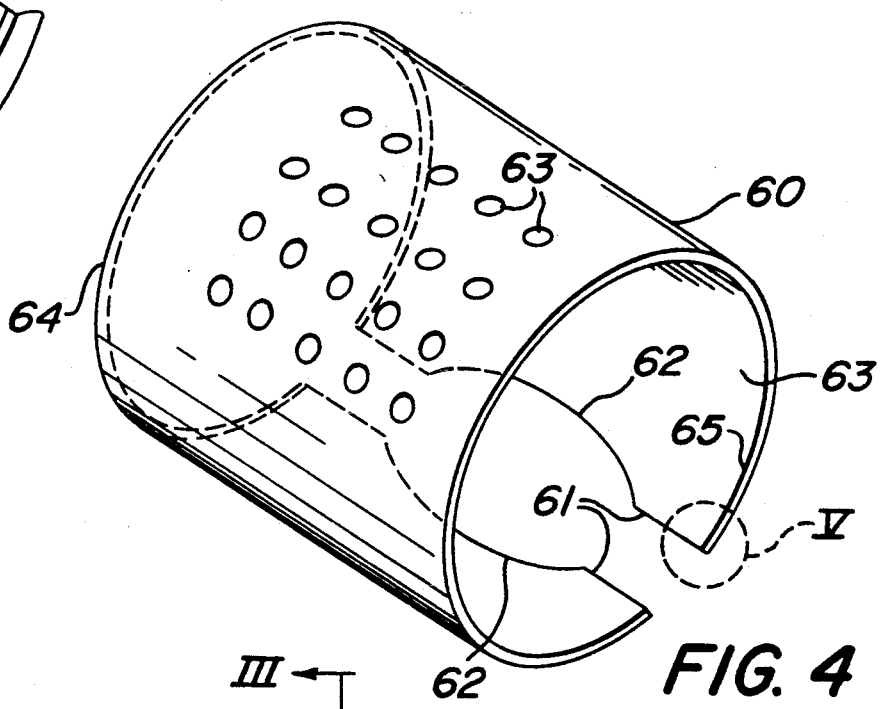
FIG. 4 is an isometric view of the steamer attachment shown in FIG. 2.
Figure 2:
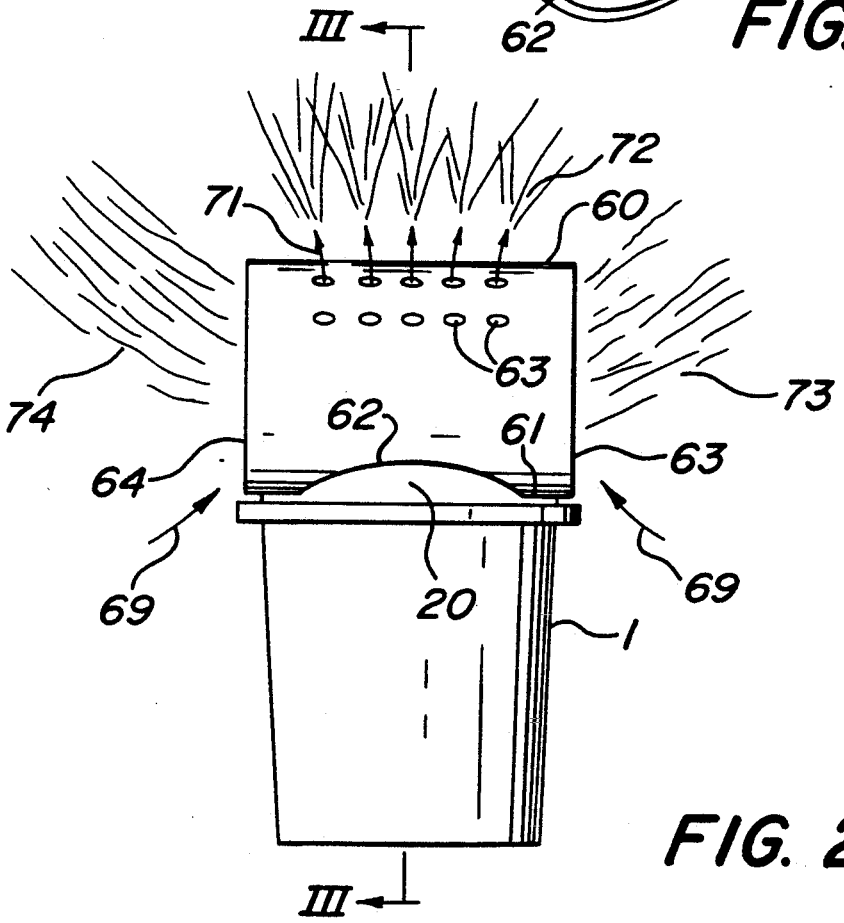
FIG. 2 is an elevation showing the steamer of FIG. 1 after being converted to a facial/hand steamer by the attachment of the current invention.

As shown in FIGS. 2 and 3, the steamer 1 is converted for use as a facial/hand steamer by the addition of an attachment, shown in FIG. 4. The attachment comprises an approximately cylindrical conduit 60, preferably formed from a flexible plastic. The conduit 60 is open at both of its ends 63 and 64 and has two longitudinally extending edges 61. Scallops 62, having a radius of curvature matching that of the cylindrical portion 20 of the cover 3, are formed in each of the edges 61. A pattern of holes 63 are formed in one quadrant of the conduit 60.

When the conduit 60 is in its undeformed state, the maximum distance between the scallops 62 in the edges 61 is less than the diameter of the cylindrical portion 20 of the cover 3. Since the conduit 60 has considerable flexibility, this feature allows it to be secured to the steamer 1 by a compression fit. Specifically, the edges 6 are manually spread apart so as to elastically deform the conduit. The conduit 60 is then placed over the cover 3 with its longitudinal axis horizontally oriented. When the conduit 60 is released, the edges 61 are urged against the cylindrical portion 20 of the cover 3 by the remaining elastic deformation, thereby providing a secure method of attaching the conduit 60 to the cover 3. As result of the elastic deformation, a substantially cylindrical conduit 60, such as that shown in FIG. 4, may assume a somewhat elliptical shape when attached to the steamer 1.

Figure 6:
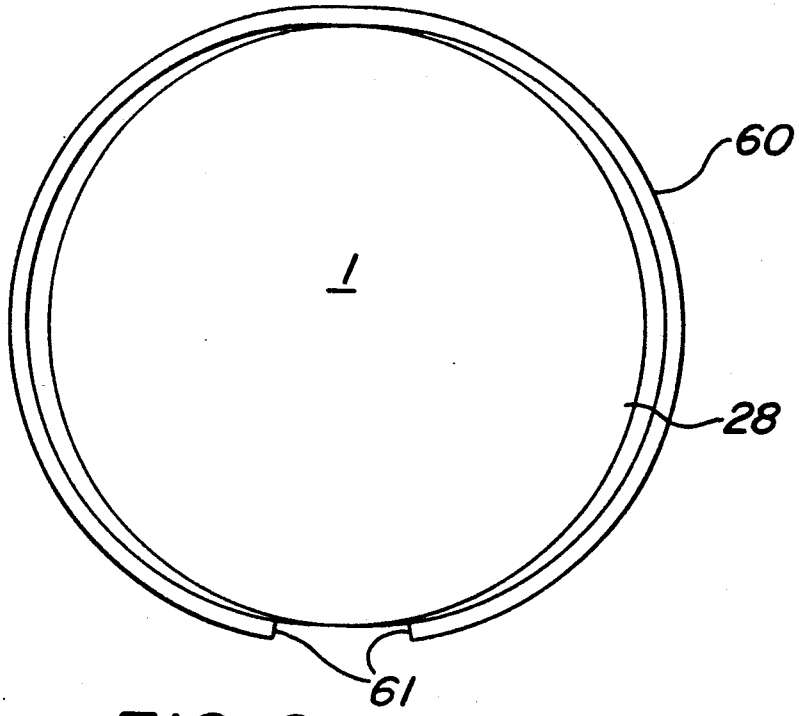
FIG. 6 is a view from below of the steamer with the attachment according to the current invention secured for storage when not in use.

In the preferred embodiment, the diameter of the conduit 60 is slightly less than the diameter of the vessel 28 and the length of the conduit is less that the height of the vessel. This allows the conduit 60 to be conveniently stored on the steamer 1 when not in use by slipping the conduit around the vessel 28, as shown in FIG. 6, so that it remains secured by an interference fit created by elastic deformation.

As shown in FIG. 3, in operation, the electrodes 6 heat the water 28 contained in the vessel 24—more specifically, they heat the portion of the water 28 that flows into the shroud 13 of the inner housing 7 via holes 32—thereby forming steam 52. The steam 52 is directed by baffle 54 to flow outward through the steam ports 10 and 38 in the inner cap 4 and cover 3, respectively, into the chamber 76 formed by the cowl 12. Any additional steam generated in the water 28 outside of the shroud 13 flows into the inner housing via hole 34 and into the chamber 76 via holes 36.

From the chamber 76, the steam discharges the steamer 1 through steam port 17 as a relatively high velocity jet of steam 70. The steam jet 70 strikes the inner surface of the conduit 60 and is divided into three streams. The first stream comprises a plurality of small steam streams 71 that are directed vertically upward by the conduit 60 so as to discharge through the holes 63 that are disposed in the top quadrant of the conduit. Just above the conduit 60, the streams 71 merge into an upward flowing mist 72 of steam especially suitable for a steam treatment of the face, as shown in FIG. 2. Advantageously, as a result of flowing through the holes 63 and coming into contact with a flow of air, induced as discussed below, the steam jet 70 has been diffused and cooled, thereby eliminating the possibility of scalding the user. The second and third streams 73 and 74 are directed by the conduit 60 to flow horizontally outward in 180° opposed directions, discharging through the open ends 63 and 64 of the conduit.

As shown in FIG. 2, the flow of steam 71 through the holes 63 in the top quadrant of the conduit provides aspiration by drawing air 69 into the conduit. The air 69 mixes with the steam streams 71, 73 and 74 aiding in their diffusion and cooling, thereby eliminating the possibility of scalding the user.

The steamer attachment according to the current invention serves to divide the steam 70 discharging from the steam port 17 into three separate streams 72, 73 and 74 and to direct these streams so that they may be used to simultaneously steam various parts of the body. As can readily be appreciated, this arrangement provides considerable flexibility. Thus, the user can be placed directly in front of the steamer—that is, facing into the paper as viewed in FIG. 2—with the hands placed around the steamer so that the right hand is opposite opening 63 and the left hand is opposite opening 64, thereby allowing steam streams 73 and 74 to treat the right and left hands, respectively, simultaneously. In addition, the user can bend forward so as to place the face over the top of the steamer, thereby allowing steam stream 72 to treat the face simultaneously with the hands. Alternatively, the user can be positioned to the right side of the steamer, as viewed in FIG. 2, with the hands placed around to the left side so that steam stream 73 treats the face, neck and chest while steam stream 64 treats the hands of the user.

Thus, the attachment according to the current invention allows the simultaneous steam treatment of several body parts, such as the face and hands. In addition, the attachment diffuses the steam jet 70 and allows it to cool somewhat into a moist vapor that will achieve the desired benefits without danger of scalding the user, especially in the sensitive face area.

Figure 5:
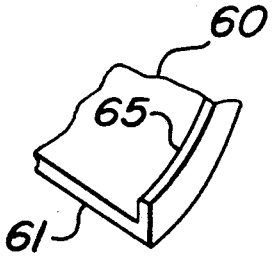
FIG. 5 is a detailed view of the portion of FIG. 4 enclosed by the circle marked V.

As shown in FIG. 5, circumferentially extending baffles 65 are formed at each of the ends 63 and 64 of the conduit 60. These baffles act as gutters to direct condensation formed on the inside surface of the conduit to a channel 66 formed between a lip 80 in the outer vessel 24 and the cover 3, as shown in FIG. 3, thereby preventing the condensate from dripping onto the table top or other surface on which the steamer 1 is supported.

Figure 7:
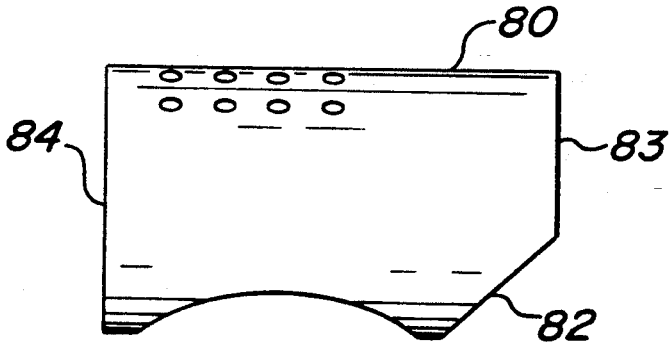
FIGS. 7 and 8 show two alternate embodiments of the attachment of current invention.
Figure 8:
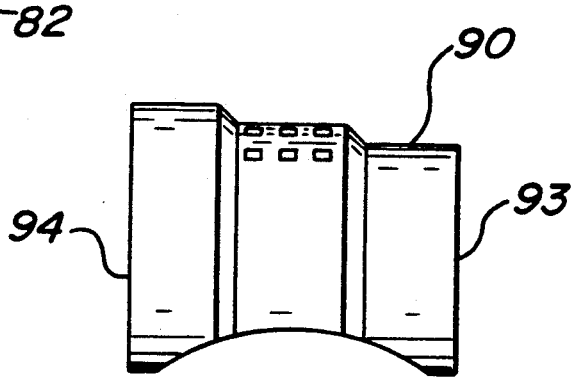

Although a simple cylindrical shape has been shown for the conduit in FIGS. 1-6, other shapes such as that shown in FIG. 7, in which the conduit 80 has a bevel edge on end 82, and that shown in FIG. 8, in which the conduit 90 is formed by concentric cylinders of varying diameter, can also be used. Such shapes may render the attachment more aesthetically appealing but can also be advantageously employed to adjust the amount of steam or the ratio of the amount of steam to the amount of aspirated air flow at each end of the attachment—for example, in attachment 90 shown in FIG. 8 the amount of steam flow from end 94 can be expected to be greater than from smaller end 93, making end 94 more suitable for steaming the face and chest and end 94 more suitable for steaming the hands. Alternatively, in the attachment 80 shown in FIG. 7 the degree of cooling due to contact with the aspirated air flow can be expected to be greater at end 83 than at end 84 due to the presence of the bevel 82, making end 83 more suitable for use in treating the face and end 84 more suitable for treating the hands.

Although in the preferred embodiment the attachment is open at both ends to allow simultaneous steaming of several body parts, the invention could also be practiced using a conduit that was closed at both ends to provide a flow of steam treatment only through the top of the conduit or closed at only one end to provide a horizontal flow of steam. Alternatively, the invention could be practiced by dispensing with the holes 63 so that the attachment directed steam only through the ends.

Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A steamer for simultaneously steaming the face and hands of the user, comprising:

a) a vessel forming a cavity for containing water;

b) means for transforming at least a portion of said water contained in said cavity to a flow of steam; and c) steam flow directing means having atmosphere disposed thereabove and having (i) first steam flow dischargit means for directing a first portion of said steam flow from said steamer substantially vertically upward directly into said atmosphere above said steam flow directing means, (ii) second steam flow discharging means for directing a second portion of said steam flow from said steamer in a first substantially horizontal direction and (iii) third steam flow discharging means for directing a third portion of said steam flow from said steamer in a second substantially horizontal direction.

2. The steamer according to claim 1, wherein said first substantially horizontal direction is oriented approximately 180° from said second substantially horizontal direction.

3. The steamer according to claim 1, wherein said vessel has a first steam port for discharging said flow of steam from said cavity as a jet of said steam into said steam flow directing means.

4. The steamer according to claim 1, wherein said steam flow directing means comprise a conduit having first and second ends and a first opening disposed between said first and second ends forming said first steam flow discharging means.

5. The steamer according to claim 4, wherein said first opening comprises a plurality of holes.

6. The steamer according to claim 4, wherein said first and second conduit ends have second and third openings, respectively, formed therein, said second and third openings forming said second and third steam flow discharging means, respectively.

7. The steamer according to claim 4, wherein said conduit is substantially cylindrical.

8. The steamer according to claim 4, wherein said conduit has means for attaching said conduit to said vessel.

9. The steamer according to claim 8, wherein said attaching means comprises a compression fit between said conduit and said vessel.

10. The steamer according to claim 9, wherein said conduit has first and second substantially longitudinal edges between which said vessel is disposed, said compression fit comprising said longitudinal edges being elastically spread apart by said vessel, whereby said longitudinal edges are opposingly biased against said vessel.

11. The steamer according to claim 4, wherein said conduit has means for directing condensation formed from said steam flow to said vessel.

12. The steamer according to claim 11, wherein said condensation directing means comprises baffles formed in each of said first and second ends of said conduit.

13. The steamer according to claim 12, wherein:

a) said vessel further comprises a channel; and b) said condensation directing means has means for directing said condensate to said channel.

14. The steamer according to claim 1, wherein said steam flow directing means comprises a conduit having an inside dimension sufficiently great to allow said conduit to be slipped around said vessel for storage.

15. The steamer according to claim 14, wherein said vessel has an outside dimension, and wherein said conduit is elastically deformable, said conduit inside dimension being less than said vessel outside dimension so as to provide an interface fit for securing said conduit to said vessel when said conduit is slipped over said vessel for storage.

16. In a steamer for supplying steam to hair curlers having (i) a vessel forming a cavity for containing water and (ii) means for transforming at least a portion of said water contained in said cavity to a flow of steam, an attachment for converting said steamer into an apparatus for supplying steam for use on one's body, comprising a conduit having:

a) a first opening for receiving said steam flow from said vessel;

b) first and second ends; and c) second and third openings for discharging first and second portions of said steam flow, said second and third openings formed in said first and second ends and oriented so as to simultaneously direct said first and second portions of said steam flow in first and second directions, respectively, outwardly from said steamer, whereby first and second portions of said body can be simultaneously steam treated.

17. The attachment according to claim 16, wherein said first and second directions are approximately 180° apart.

18. The attachment according to claim 16, wherein said conduit is approximately cylindrical, the longitudinal axis of said cylinder being substantially horizontally disposed.

19. In a steamer for supplying steam to hair curlers having (i) a vessel forming a cavity for containing water and (ii) means for transforming at least a portion of said water contained in said cavity to a flow of steam, an attachment for converting said steamer into an apparatus for supplying steam for use on one's body, comprising a conduit having:

a) a first opening for receiving said steam flow from said vessel;

b) second and third openings for discharging first and second portions of said steam flow, said second and third openings oriented so as to simultaneously direct said first and second portions of said steam flow in first and second directions, respectively, whereby first and second portions of said body can be simultaneously steam treated: and c) means for causing said first portion of said steam flow to be greater than said second portion of said steam flow.

20. The attachment according to claim 19, wherein said means for causing said first portion of said steam flow to be greater than said second portion of said steam flow comprises said second opening being larger than said first opening.

21. The attachment according to claim 16, wherein said conduit comprises a fourth opening for discharging a third portion of said steam flow, said fourth opening oriented to direct said third portion of said steam flow in a third direction, whereby a third portion of said body can be simultaneously steam treated along with said first and second portions of said body.

22. The steamer according to claim 16, further comprising means for cooling and diffusing said steam flow from said vessel.

23. In a steamer for supplying steam to hair curlers having (i) a vessel forming a cavity for containing water and (ii) means for transforming at least a portion of said water contained in said cavity to a flow of steam, an attachment for converting said steamer into an apparatus for supplying steam for use on one's body, comprising a conduit having:

a) a first opening for receiving said steam flow from said vessel;

b) second and third openings for discharging first and second portions of said steam flow, said second and third openings oriented so as to simultaneously direct said first and second portions of said steam flow in first and second directions, respectively, whereby first and second portions of said body can be simultaneously steam treated; and c) means for cooling and diffusing said steam flow from said vessel, said steam flow diffusing and cooling means comprising means for drawing a flow of air into said conduit for contact with said steam flow.

24. The steamer according to claim 23, wherein said air flow drawing means comprises means for drawing air into said second and third openings.

25. The steamer according to claim 24, wherein said air flow drawing means comprises means for drawing more air into said second opening than into said third opening.

26. The steamer according to claim 23, wherein said air flow drawing means comprises a fourth opening in said conduit disposed between said second and third openings.

27. The steamer according to claim 26, wherein said conduit has an upper portion and said fourth opening comprises a plurality of holes formed in said upper portion of said conduit.

28. A steamer for providing steam to a hair curler when operating in a first mode and for providing steam to one's body when operating in a second mode, comprising:

a) a vessel forming a cavity for containing water;

b) an electrode for heating said water contained in said cavity, thereby transforming at least a portion of said water to steam;

c) a surface for supporting a hair curler;

d) a first steam discharge port disposed in said support surface and adapted to discharge a net of said steam upwardly from said cavity to said hair curler when operating in said first mode; and e) a conduit for diffusing said steam jet and for directing at least a portion of said steam jet to said body when operating in said second mode.

29. The steamer according to claim 28, wherein said conduit has a plurality of holes formed therein.

30. The steamer according to claim 28, wherein said conduit is attached to said cover and oriented so that its longitudinal axis is substantially horizontal.

31. A steamer for providing steam to a hair curler when operating in a first mode and for providing steam to one's body when operating in a second mode, comprising:

a) a vessel forming a cavity for containing water;

b) an electrode for heating said water contained in said cavity, thereby transforming at least a portion of said water to steam;

c) a surface for supporting a hair curler above said vessel;

d) a first steam discharge port adapted to discharge a jet of said steam upwardly from said cavity to said hair curler when operating in said first mode; and e) means for directing at least a portion of said steam substantially horizontally outward from said steamer and toward said body when operating in said second mode.

32. A steamer for simultaneously steaming the face and hands of the user, comprising:

a) a vessel forming a cavity for containing water;

b) means for transforming at least a portion of said water contained in said cavity to a flow of steam; and c) steam flow directing means disposed atop said vessel and having (i) a first steam flow discharge port adapted to direct a first portion of said steam flow outwardly from said steamer in a substantially vertically upward direction, and (ii) a second steam flow discharge port adapted to direct a second portion of said steam flow outward from said steamer in a substantially horizontal direction.

* * * * *